US009303636B2

(12) United States Patent
Joung et al.

(10) Patent No.: US 9,303,636 B2
(45) Date of Patent: Apr. 5, 2016

(54) SYSTEM FOR CONTROLLING HYDRAULIC PUMP IN CONSTRUCTION MACHINE

(75) Inventors: Hea-Gyoon Joung, Busan (KR); Sang-Hee Lee, Changwon-si (KR); Hung-Ju Shin, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 515 days.

(21) Appl. No.: 13/810,824

(22) PCT Filed: Jul. 19, 2010

(86) PCT No.: PCT/KR2010/004692

§ 371 (c)(1),
(2), (4) Date: Jan. 17, 2013

(87) PCT Pub. No.: WO2012/011615

PCT Pub. Date: Jan. 26, 2012

(65) Prior Publication Data

US 2013/0121852 A1 May 16, 2013

(51) Int. Cl.
*F16D 31/02* (2006.01)
*F04B 39/00* (2006.01)
(Continued)

(52) U.S. Cl.
CPC ..... *F04B 39/00* (2013.01); *E02F 9/2214* (2013.01); *E02F 9/2235* (2013.01); *E02F 9/2242* (2013.01); *E02F 9/2296* (2013.01);
(Continued)

(58) Field of Classification Search
CPC ... F16H 61/431; F16H 61/433; F16H 61/472; F15B 11/165; E02F 9/2242; E02F 9/2235; E02F 9/2296; E02F 9/2214
See application file for complete search history.

(56) References Cited

U.S. PATENT DOCUMENTS 4,967,557 A * 11/1990 Izumi et al. ..... 60/423
5,083,430 A 1/1992 Hirata et al.
(Continued)

FOREIGN PATENT DOCUMENTS

JP 61-054503 10/1987
JP 10-246204 9/1998
(Continued)

OTHER PUBLICATIONS

International Search Report (in Korean and English) and Written Opinion (in Korean) for PCT/KR2010/004692, mailed Apr. 21, 2011; ISA/KR.
(Continued)

*Primary Examiner* — Michael Leslie
(74) *Attorney, Agent, or Firm* — Harness, Dickey & Pierce, P.L.C.

(57) ABSTRACT

Disclosed is a system for controlling a hydraulic pump in a construction machine which can reduce the discharge flow of the hydraulic pump in proportion to the load pressure of the hydraulic pump to enhance operability by the driver. The present invention provides the system for controlling the hydraulic pump in the construction machine, which is characterized by detecting the discharge pressure of the hydraulic pump and the operation activity of an operation lever, and comparing the detected discharge pressure of the hydraulic pump and a predetermined pressure value, and when the detected discharge pressure exceeds the predetermined pressure value, the maximum dischargeable flow of the hydraulic pump is reduced in proportion to the difference between the detected pressure and the predetermined pressure value.

4 Claims, 4 Drawing Sheets

(51) Int. Cl.
*E02F 9/22* (2006.01)
*F04B 49/08* (2006.01)

(52) U.S. Cl.
CPC ..... *F04B 49/08* (2013.01); *F04B 2205/05* (2013.01); *F15B 2211/253* (2013.01); *F15B 2211/6309* (2013.01); *F15B 2211/6346* (2013.01)

(56) References Cited

U.S. PATENT DOCUMENTS

| | | | | |
|---|---|---|---|---|
| 5,134,853 | A | 8/1992 | Hirata et al. | |
| 5,177,964 | A | 1/1993 | Tanaka et al. | |
| 5,186,000 | A * | 2/1993 | Hirata et al. | 60/420 |
| 5,267,440 | A | 12/1993 | Nakamura et al. | |
| 5,289,679 | A * | 3/1994 | Yasuda | 60/422 |
| 5,295,795 | A * | 3/1994 | Yasuda et al. | 417/213 |
| 5,447,027 | A * | 9/1995 | Ishikawa et al. | 60/420 |
| 5,630,317 | A | 5/1997 | Takamura et al. | |
| 5,638,677 | A * | 6/1997 | Hosono et al. | 60/431 |
| 5,839,279 | A | 11/1998 | Moriya et al. | |
| 5,996,341 | A * | 12/1999 | Tohji | 60/421 |
| 6,308,516 | B1 | 10/2001 | Kamada | |
| 7,155,909 | B2 * | 1/2007 | Toji | 60/468 |
| 7,431,101 | B2 | 10/2008 | Hacker | |
| 7,487,609 | B2 | 2/2009 | Nakamura et al. | |
| 7,779,630 | B2 | 8/2010 | Sakamoto | |
| 8,327,638 | B2 | 12/2012 | Ohtsukasa | |
| 8,818,651 | B2 | 8/2014 | Joung et al. | |
| 2003/0019209 | A1 | 1/2003 | Tsuruga et al. | |
| 2006/0229787 | A1 | 10/2006 | Kurup et al. | |
| 2007/0012039 | A1 | 1/2007 | Takebe | |
| 2007/0125078 | A1 | 6/2007 | Tanaka et al. | |
| 2009/0151346 | A1 | 6/2009 | Kim | |
| 2009/0248259 | A1 | 10/2009 | Lee | |
| 2009/0293468 | A1 * | 12/2009 | Kim | 60/327 |
| 2010/0170239 | A1 | 7/2010 | Sora | |
| 2013/0098021 | A1 | 4/2013 | Shin et al. | |
| 2013/0263583 | A1 | 10/2013 | Shin | |
| 2013/0318971 | A1 | 12/2013 | Sora | |
| 2014/0000252 | A1 | 1/2014 | Sora | |

FOREIGN PATENT DOCUMENTS

| | | | | |
|---|---|---|---|---|
| JP | 11-044291 | A | 2/1999 | |
| KR | 10-1997-0001723 | B1 | 2/1997 | |
| KR | 10-0337091 | B1 | 12/2002 | |
| KR | 20030087247 | A | 11/2003 | |
| KR | 10-0974275 | B1 | 8/2010 | |
| KR | 10-0974279 | B1 | 8/2010 | |
| WO | WO 2012002586 | A1 * | 1/2012 | F15B 9/04 |

OTHER PUBLICATIONS

International Preliminary Report on Patentability (Chapter II of the Patent Cooperation Treaty) (in Korean) for PCT/KR2010/004692, dated Nov. 23, 2012; IPEA/KR.

Japanese Office Action for Japan Application No. 2013-520626 mailed May 7, 2014.

* cited by examiner

SYSTEM FOR CONTROLLING HYDRAULIC PUMP IN CONSTRUCTION MACHINE

FIELD OF THE INVENTION

The present invention relates to a system for controlling a hydraulic pump included in a construction machine. More particularly, the present invention relates to a hydraulic pump control system for a construction machine such as an excavator or the like, in which the flow rate of a fluid discharged from a variable displacement hydraulic pump (hereinafter, referred to as"hydraulic pump") can be variably controlled in response to a load pressure generated in the hydraulic pump.

BACKGROUND OF THE INVENTION

In general, a main relief valve is included in a hydraulic system of a hydraulic construction machine such as an excavator or the like, so that when a load pressure of a hydraulic pump exceeds a predetermined pressure, the main relief valve allows a hydraulic fluid discharged from a hydraulic pump to be drained to a hydraulic tank, thereby preventing a damage of hydraulic components. In addition, the hydraulic system employs a hydraulic control method in which the load pressure is restricted so as not to exceed a preset specific horsepower or torque value to reduce the discharge flow rate of the hydraulic pump.

The main relief valve applied to such a hydraulic system allows the hydraulic fluid to be drained to the hydraulic tank before the discharge pressure of the hydraulic pump reaches a preset value of the relief valve as shown in FIG. 2. In this case, since the hydraulic pump continues to discharge the hydraulic fluid, fuel is wasted unnecessarily due to an undesired driving of the hydraulic pump.

Conventionally, the hydraulic system is constructed such that when the discharge pressure of the hydraulic pump is more than the preset value of the relief valve, the relief valve is turned on or off in order to reduce a loss of the flow rate of the hydraulic fluid as mentioned above. In other words, when discharge pressure of the hydraulic pump is more than the preset value of the relief valve, the discharge flow rate of the hydraulic pump is abruptly reduced, and thus a shock occurs in the hydraulic system. This results in a deterioration of a manipulation feeling felt by an operator when a work apparatus such as a boom or the like is driven by the operator.

DETAILED DESCRIPTION OF THE INVENTION

Technical Problems

Accordingly, the present invention was made to solve the aforementioned problem occurring in the prior art, and it is an object of the present invention to provide a hydraulic pump control system for a construction machine, in which when a load pressure of a hydraulic pump is more than a preset value, a maximum dischargeable flow rate of the hydraulic pump can be restricted to reduce a loss of the flow rate.

Another aspect of the present invention is to provide a hydraulic pump control system for a construction machine, in which a discharge flow rate of a hydraulic pump can be reduced proportionally in response to a load pressure of the hydraulic pump to improve manipulability of an operator.

Technical Solution

To accomplish the above object, in accordance with an embodiment of the present invention, there is provided a hydraulic pump control system for a construction machine, including a variable displacement hydraulic pump, at least one hydraulic actuator connected to the hydraulic pump, a spool configured to control hydraulic fluid supplied to the actuator when the spool is shifted by a signal pressure that is supplied to the spool in proportion to an manipulation amount of the manipulation lever, a discharge pressure detection sensor installed in a discharge flow path of the hydraulic pump and configured to detect discharge pressure of the hydraulic pump, a signal pressure detection sensor configured to detect the signal pressure based on the manipulation amount of the manipulation lever, and a control unit configured to control a discharge flow rate of the hydraulic pump in response to the detection signals from the detection sensors, the hydraulic pump control system including:

- a first step of detecting the discharge pressure of the hydraulic pump and the manipulation amount of the operation lever by the detection sensors;
- a second step of calculating a flow rate required by the hydraulic pump based on the manipulation amount of the manipulation lever;
- a third step of comparing the sizes of the detected discharge pressure of the hydraulic pump and a preset pressure value;
- a fourth step of proportionally reducing, if the detected discharge pressure of the hydraulic pump 2 is more than the preset pressure value, a maximum dischargeable flow rate of the hydraulic pump based on a difference between the detected discharge pressure and the preset pressure value;
- a fifth step of comparing a currently detected torque value of the hydraulic pump with the maximum dischargeable flow rate of the hydraulic pump; and
- a sixth step of controlling the discharge flow rate of the hydraulic pump to be the maximum dischargeable flow rate if the currently detected torque value of the hydraulic pump exceeds the maximum dischargeable flow rate, while controlling the discharge flow rate of the hydraulic pump to be the flow rate required by the hydraulic pump, which is calculated based on the manipulation amount, if the currently detected torque value of the hydraulic pump is less than the maximum dischargeable flow rate.

According to a more preferable embodiment, the control unit controls a function of reducing the discharge flow rate of the hydraulic pump to be released if a system pressure boost-up function is selected by a user.

The control unit controls, if the detected discharge pressure is more than the preset pressure even in the case where the discharge flow rate required by the hydraulic pump 2 does not reach the maximum dischargeable flow rate in the above sixth step, the discharge flow rate required by the hydraulic pump 2 to be proportionally reduced based on a difference between the detected discharge pressure and the preset pressure value in such a manner that the degree of reduction is proportionally controlled based on the size of the discharge flow rate so that the reduction rate of the discharge flow rate is controlled to be equal to or to approximate the size of the discharge flow rate required by the hydraulic pump 2.

Advantageous Effect

The hydraulic pump control system for a construction machine according to an embodiment of the present invention as constructed above has the following advantages.

When a load pressure of a hydraulic pump is more than a preset value, a maximum dischargeable flow rate of the hydraulic pump can be restricted to reduce a loss of the flow rate being relieved, thereby improving fuel efficiency. In addition, a discharge flow rate of a hydraulic pump can be reduced proportionally in response to a load pressure of the hydraulic pump to improve manipulability of an operator.

BRIEF DESCRIPTION OF THE INVENTION

The above objects, other features and advantages of the present invention will become more apparent by describing the preferred embodiments thereof with reference to the accompanying drawings, in which.

Figure 4:
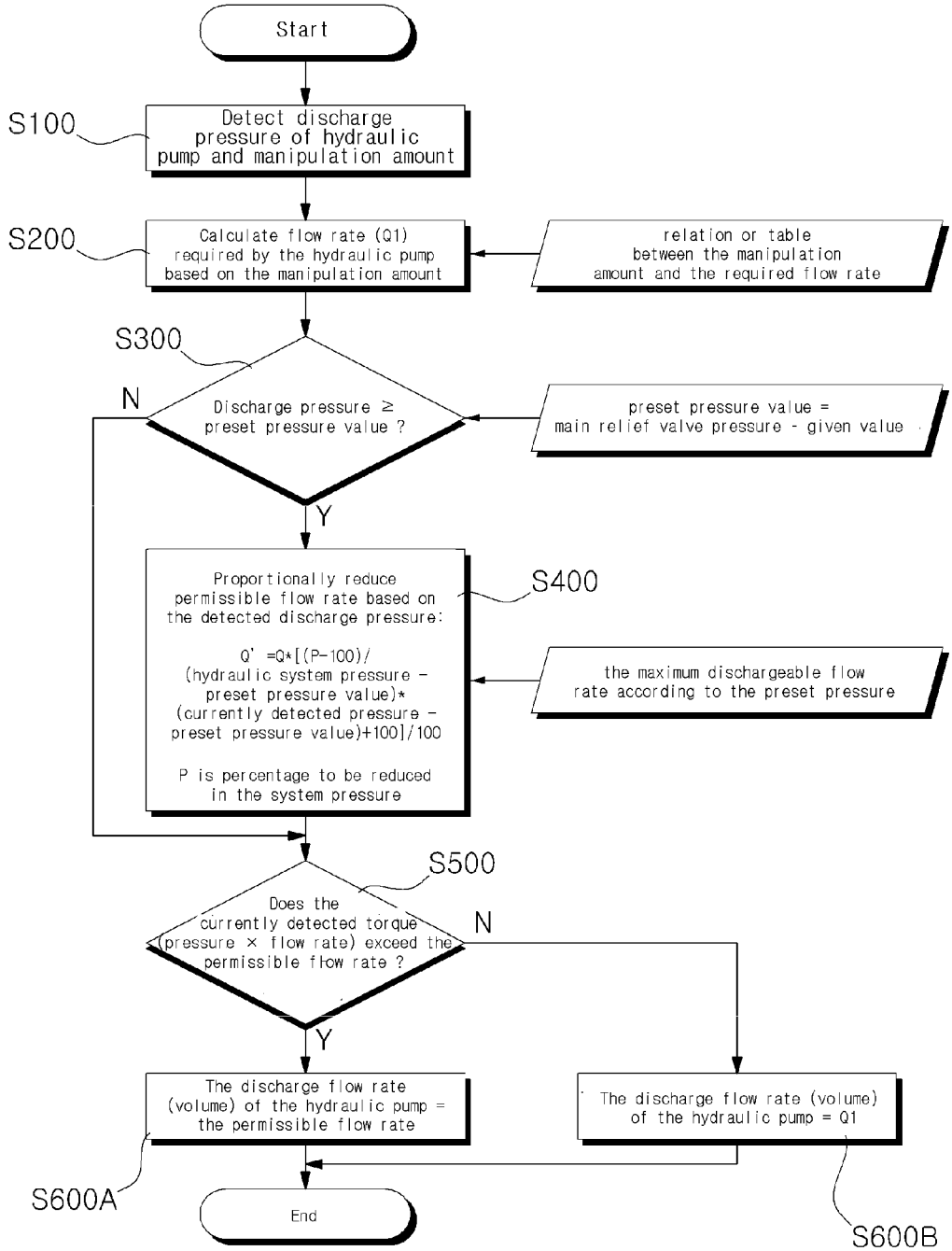
Figure 5:
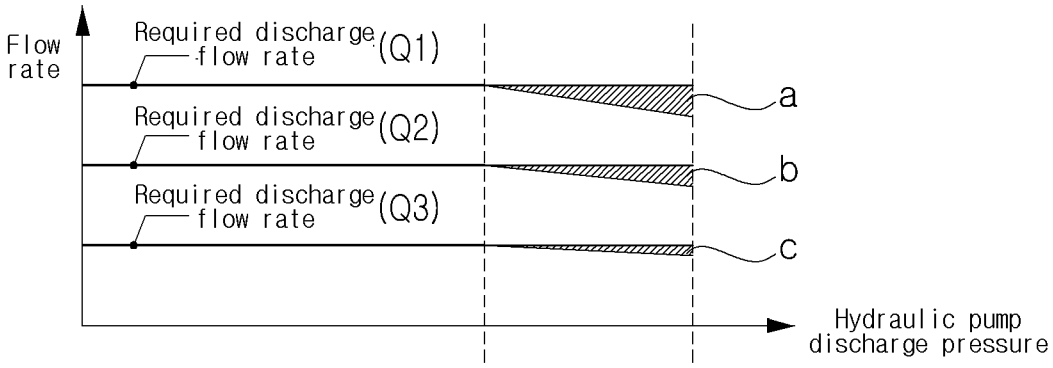

FIG. 4 is a flowchart illustrating the operation of a hydraulic pump control system for a construction machine according to an embodiment of the present invention; and FIG. 5 is a graph illustrating the relationship between a discharge pressure of a hydraulic pump and the required discharge flow rate in which the flow rate of the hydraulic pump is proportionally reduced in a hydraulic pump control system for a construction machine according to an embodiment of the present invention.

EXPLANATION ON REFERENCE NUMERALS OF MAIN ELEMENTS IN THE DRAWINGS

1: engine
2: variable displacement hydraulic pump
3: pilot pump
4: manipulation lever
5: spool
6: discharge flow path
7, 8: detection sensor
9: control unit
10: proportional control valve

PREFERRED EMBODIMENTS OF THE INVENTION

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and thus the present invention is not limited to the embodiments disclosed hereinafter.

Figure 1:
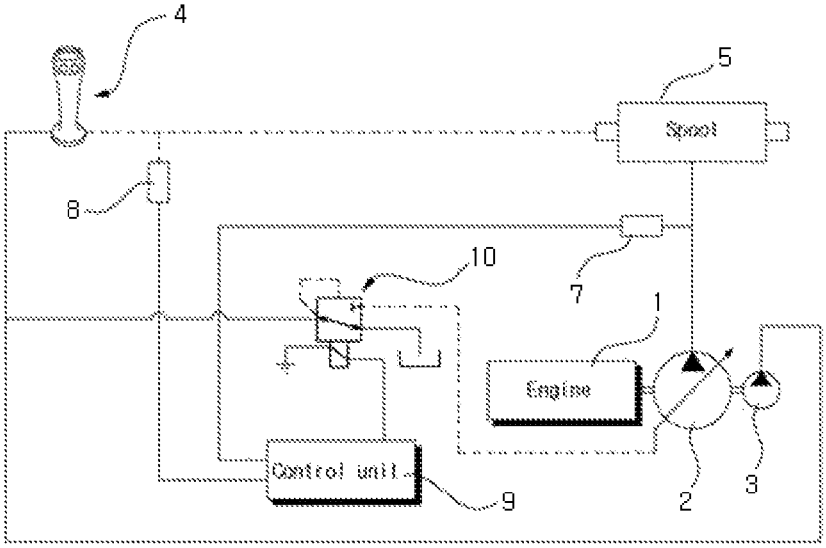
FIG. 1 is a schematic circuit diagram applied to a hydraulic pump control system for a construction machine in accordance with an embodiment of the present invention.
Figure 3:
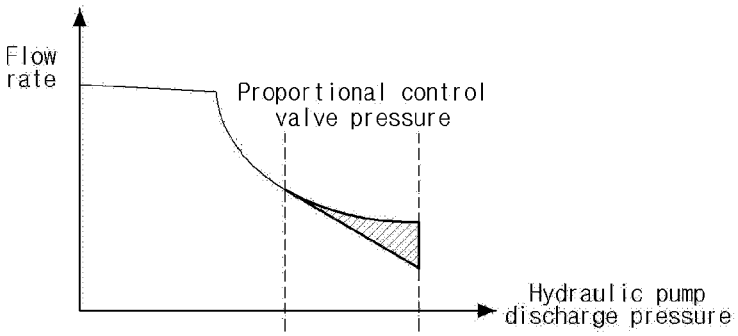
FIG. 3 is a graph illustrating the relationship between a discharge pressure of a hydraulic pump and a pressure of a main relief valve in a hydraulic pump control system for a construction machine according to an embodiment of the present invention.

As shown in FIGS. 1, 3 and 4, the hydraulic pump control system for a construction machine according to an embodiment of the present invention comprises a variable displacement hydraulic pump (hereinafter, referred to as "hydraulic pump") 2 and a pilot pump 3, which are connected to an engine 1, at least one hydraulic actuator (referring to a boom cylinder, an arm cylinder, a bucket cylinder, or the like, which is not shown) connected to the hydraulic pump 2, a spool 5 configured to control hydraulic fluid supplied to a corresponding actuator when the spool 5 is shifted by a pilot signal pressure that is supplied to the spool from the pilot pump 3 in proportion to an manipulation amount of the manipulation lever 4, a discharge pressure detection sensor 7 installed in a discharge flow path of the hydraulic pump 2 and configured to detect a discharge pressure of the hydraulic pump 2, a signal pressure detection sensor 8 configured to detect the pilot signal pressure (referring to a secondary signal pressure to shift the spool 5 based on the manipulation amount of the manipulation lever 4, and a control unit 9 configured to control a discharge flow rate of the hydraulic pump 2 in response to the detection signals from the detection sensors 7 and 8.

The hydraulic pump control system comprises:

- a first step S100 of detecting the discharge pressure of the hydraulic pump 2 and the manipulation amount of the operation lever 4 by the detection sensors 7 and 8;
- a second step S200 of calculating a flow rate Q1 required by the hydraulic pump 2 based on the manipulation amount of the manipulation lever 4;
- a third step S300 of comparing the sizes of the discharge pressure of the hydraulic pump 2 detected by the detection sensor 7 and a preset pressure value;
- a fourth step S400 of proportionally reducing, if the detected discharge pressure of the hydraulic pump 2 is more than the preset pressure value, a maximum dischargeable flow rate of the hydraulic pump 2 based on a difference between the detected discharge pressure and the preset pressure value;
- a fifth step S500 of comparing a currently detected torque (pressure×flow rate) value of the hydraulic pump 2 with the maximum dischargeable flow rate of the hydraulic pump 2; and
- a sixth step S600A; S600B of controlling the discharge flow rate of the hydraulic pump 2 to be the maximum dischargeable flow rate if the currently detected torque value of the hydraulic pump 2 exceeds the maximum dischargeable flow rate, while controlling the discharge flow rate of the hydraulic pump 2 to be the flow rate Q1 required by the hydraulic pump 2, which is calculated based on the manipulation amount in the step S200, if the currently detected torque value of the hydraulic pump 2 is less than the maximum dischargeable flow rate.

In the drawings, a non-explained reference numeral 10 denotes a proportional control valve that converts a pilot signal pressure applied to the spool 5 via the manipulation lever 4 to be proportion to a control signal from the control unit 9 so as to control the discharge flow rate of the hydraulic pump 2.

Hereinafter, an example of the hydraulic pump control system for a construction machine according to an embodiment of the present invention will be described in detail with reference to the accompanying drawings.

As shown in FIGS. 1 and 4, the manipulation amount of the operation lever 4 and the discharge pressure of the hydraulic pump 2 are detected by the detection sensors 7 and 8, and the detected manipulation amount and the detected discharge pressure are applied to the control unit 9 (see S100).

At step S200, a discharge flow rate Q1 required by the hydraulic pump 2 is calculated based on the manipulation amount of the manipulation lever 4. That is, the flow rate Q1 required by the hydraulic pump 2 relative to the manipulation amount of the manipulation lever 4 is calculated based on a relationship equation or a table (a graph or chart not shown as an example can be used).

At step S300, the control unit 9 compares the sizes of the discharge pressure of the hydraulic pump 2 detected by the detection sensor 7 with a preset pressure value, and determines a comparison result. In this case, the preset pressure value means a value obtained by subtracting a given value from a set pressure of the main relief value (i.e., preset pressure value=preset pressure of the main relief valve−given value, which varies depending on a hydraulic system of the construction equipment).

If it is determined at step S300 that if the detected discharge pressure value of the hydraulic pump 2 is more than the preset pressure value, the program proceeds to step S400. On the contrary, if it is determined at step S300 that if the detected discharge pressure value of the hydraulic pump 2 is less than the preset pressure value, the program proceeds to step S500.

In other words, at step S300, if the detected discharge pressure value of the hydraulic pump 2 is more than the preset pressure value, the program proceeds to step S400 where the control unit 9 controls a maximum dischargeable flow rate Q of the hydraulic pump 2 to be proportionally reduced based on a difference between the detected discharge pressure and the preset pressure value (shown in FIG. 3).

In this case, the proportionally reduced maximum dischargeable flow rate Q' of the hydraulic pump 2 is written as follows:

$$Q'=Q\times[(P-100)/(\text{hydraulic system pressure}-\text{preset pressure value})\times(\text{currently detected pressure}-\text{preset pressure value})+100]/100$$

wherein P means a percentage to be reduced in the system pressure.

Meanwhile, the control unit controls a function of reducing the discharge flow rate of the hydraulic pump 2 to be released if a system pressure boost-up function is selected by a user (i.e., referring to the case where the operator selects the system pressure boost-up function intentionally to prevent the drive speed of a work apparatus or the like from being lowered).

Subsequently, the program proceeds to step S500 where the control unit 9 compares a currently detected torque (pressure×flow rate) value of the hydraulic pump 2 with the maximum dischargeable flow rate of the hydraulic pump 2 and determines a comparison result. If it is determined at step S500 that the currently detected torque value of the hydraulic pump 2 is more than the maximum dischargeable flow rate of the hydraulic pump 2, the program proceeds to step S600A. On the contrary, if it is determined at step S500 that if the currently detected torque value of the hydraulic pump 2 is less than the maximum dischargeable flow rate of the hydraulic pump 2, the program proceeds to step S600B.

That is, at step S500, if the currently detected torque value of the hydraulic pump 2 is more than the maximum dischargeable flow rate of the hydraulic pump 2, the program proceeds to step S600A where the control unit 9 controls the discharge flow rate (i.e., volume) to be the maximum dischargeable flow rate.

Contrarily, at step S500, if the currently detected torque value of the hydraulic pump 2 is less than the maximum dischargeable flow rate of the hydraulic pump 2, the program proceeds to step S600B where the control unit 9 controls the discharge flow rate (i.e., volume) to be the flow rate required by the hydraulic pump 2, which is calculated based on the manipulation amount at step S200.

Figure 2:
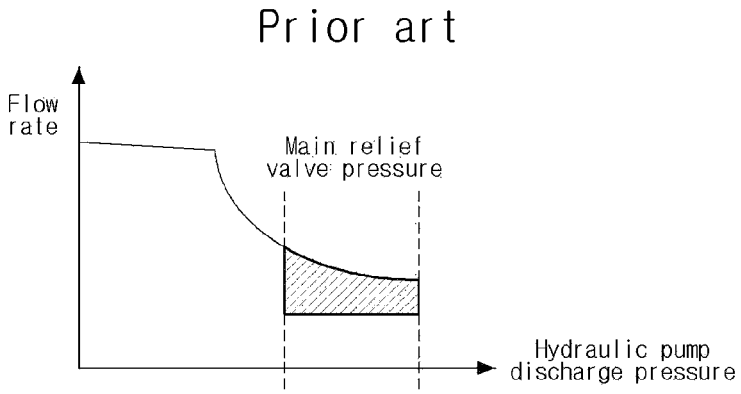
FIG. 2 is a graph illustrating the relationship between a discharge pressure of a hydraulic pump and a pressure of a main relief valve in a hydraulic pump control system for a construction machine according to the prior art.

As shown in FIG. 3, the hydraulic pump control system for a construction machine according to an embodiment of the present invention proportionally restricts the maximum dischargeable flow rate of the hydraulic pump 2 until the discharge pressure of the hydraulic pump 2 reaches the pressure of the main relief valve starting from a point at which the discharge pressure of the hydraulic pump 2 is smaller than a pressure of the main relief valve by a given value. For this reason, it is possible to relatively reduce the flow rate (a portion indicated by oblique lines descending toward the left) of a hydraulic fluid drained to the hydraulic tank and lost through the main relief valve according to the prior art as shown in FIG. 2.

In addition, when the operator manipulates the manipulation lever (RCV) to drive the work apparatus, the operator's manipulation feeling can be prevented from deteriorated due to an abrupt reduction in the flow rate.

In the meantime, as shown in FIG. 5, if the detected discharge pressure is more than the preset pressure even in the case where the discharge flow rate Q1,Q2 or Q3 required by the hydraulic pump 2 does not reach the maximum dischargeable flow rate at step S600B, the control unit 9 controls the discharge flow rate required by the hydraulic pump 2 to be proportionally reduced based on a difference between the detected discharge pressure and the preset pressure value in such a manner that the degree of reduction is proportionally controlled based on the size (Q1>Q2>Q3) of the discharge flow rate so that the reduction rate of the discharge flow rate is controlled to be equal to or to approximate the size of the discharge flow rate required by the hydraulic pump 2.

In other words, if the discharge flow rate required by the hydraulic pump 2 is Q1, the control unit 9 controls the discharge flow rate to be proportionally reduced by an a portion "a" indicated by oblique lines, and if the discharge flow rate required by the hydraulic pump 2 is Q2 (Q1>Q2), the control unit 9 controls the discharge flow rate to be proportionally reduced by an a portion "b" indicated by oblique lines (i.e., controls the discharge flow rate to be reduced by "b" relative to "a" based on a difference between the discharge flow rates Q1 and Q2. If the discharge flow rate required by the hydraulic pump 2 is Q3 (Q1>Q3), the control unit 9 controls the discharge flow rate to be proportionally reduced by an a portion "c" indicated by oblique lines (i.e., controls the discharge flow rate to be reduced by "c" relative to "a" based on a difference between the discharge flow rates Q1 and Q3.

In this case, the control unit controls a function of reducing the discharge flow rate of the hydraulic pump 2 to be released if the system pressure boost-up function is selected by a user (i.e., referring to the case where the operator selects the system pressure boost-up function intentionally to prevent the drive speed of a work apparatus or the like from being lowered).

INDUSTRIAL APPLICABILITY

In the hydraulic pump control system for a construction machine according to an embodiment of the present invention as constructed above when a load pressure of the hydraulic pump is more than a preset value, a maximum dischargeable flow rate of the hydraulic pump can be restricted proportionally to reduce a loss of the flow rate being relieved, thereby improving fuel efficiency and manipulability of an operator.

The invention claimed is:

1. A hydraulic pump control system for a construction machine, comprising a variable displacement hydraulic pump, at least one hydraulic actuator connected to the hydraulic pump, a spool configured to control hydraulic fluid supplied to the actuator when the spool is shifted by a signal pressure that is supplied to the spool in proportion to a manipulation amount of a manipulation lever, a discharge pressure detection sensor installed in a discharge flow path of the hydraulic pump and configured to detect a discharge pressure of the hydraulic pump, a signal pressure detection sensor configured to detect the signal pressure based on the manipulation amount of the manipulation lever, and a control unit configured to control a discharge flow rate of the hydraulic pump in response to the discharge pressure detection sensor and a signal pressure detection signal from the detection sensors, the hydraulic pump control system comprising:

a first step of detecting the discharge pressure of the hydraulic pump and the manipulation amount of the operation lever by the discharge pressure detection sensor and the signal pressure detection sensor;

a second step of calculating a flow rate required by the hydraulic pump based on the manipulation amount of the manipulation lever;

a third step of comparing the sizes of the detected discharge pressure of the hydraulic pump and a preset pressure value;

a fourth step of proportionally reducing, if the detected discharge pressure of the hydraulic pump is more than the preset pressure value, a maximum dischargeable flow rate of the hydraulic pump based on a difference between the detected discharge pressure and the preset pressure value, the maximum dischargeable flow rate of the hydraulic pump is reduced using a proportional control valve;

a fifth step of comparing a currently required flow rate of the hydraulic pump with the maximum dischargeable flow rate of the hydraulic pump; and a sixth step of controlling the discharge flow rate of the hydraulic pump to be the maximum dischargeable flow rate if the currently required flow rate of the hydraulic pump exceeds the maximum dischargeable flow rate, while controlling the discharge flow rate of the hydraulic pump to be the flow rate required by the hydraulic pump, which is calculated based on the manipulation amount, if the currently required flow rate of the hydraulic pump is less than the maximum dischargeable flow rate;

wherein if the detected discharge pressure is more than the preset pressure value even in the case where the discharge flow rate required by the hydraulic pump does not reach the maximum dischargeable flow rate in the sixth step, the discharge flow rate required by the hydraulic pump is proportionally reduced based on a difference between the detected discharge pressure and the preset pressure value in such a manner that the degree of reduction is proportionally controlled based on the size of the discharge flow rate so that the reduction rate of the discharge flow rate is controlled to be equal to, or to approximate the size of, the discharge flow rate required by the hydraulic pump.

2. The hydraulic pump control system according to claim 1, wherein the control unit controls a function of reducing the discharge flow rate of the hydraulic pump to be released if a system pressure boost-up function is selected by a user.

3. A method for controlling a variable displacement hydraulic pump of an excavator configured to move a boom of the excavator, the method comprising:

detecting discharge pressure of the hydraulic pump with a discharge pressure detection sensor;

detecting a manipulation amount of an operation lever moved by an operator to control the hydraulic pump and the boom with a signal pressure detection sensor;

determining a required flow rate of the hydraulic pump based on the manipulation amount of the manipulation lever;

comparing the detected discharge pressure of the hydraulic pump to a predetermined pressure value;

if the detected discharge pressure of the hydraulic pump is greater than the predetermined pressure value, proportionally reducing a maximum dischargeable flow rate of the hydraulic pump based on a difference between the detected discharge pressure and the predetermined pressure value;

comparing a currently required flow rate of the hydraulic pump with the maximum dischargeable flow rate of the hydraulic pump;

if the currently required flow rate of the hydraulic pump exceeds the maximum dischargeable flow rate: controlling a discharge flow rate of the hydraulic pump to be the maximum dischargeable flow rate;

if the currently required flow rate of the hydraulic pump is less than the maximum dischargeable flow rate: controlling the discharge flow rate of the hydraulic pump to be the flow rate required by the hydraulic pump, which is based on the manipulation amount; and if the detected discharge pressure of the hydraulic pump is greater than the predetermined pressure value and the discharge flow rate required by the hydraulic pump is less than the maximum dischargeable flow rate: proportionally reducing the discharge flow rate of the hydraulic pump based on the difference between the detected discharge pressure and the predetermined pressure value such that the reduction is proportional to amount of the discharge flow rate, and the greater the discharge flow rate the greater the reduction.

4. The method of claim 3, wherein the required flow rate of the hydraulic pump based on the manipulation amount of the manipulation lever is determined according to a predetermined look-up table.

* * * * *